US007827740B2

(12) United States Patent
Lin

(10) Patent No.: US 7,827,740 B2
(45) **Date of Patent: *Nov. 9, 2010**

(54) AERODYNAMIC ROOF EDGE GUARD

(75) Inventor: Jason JianXiong Lin, Cary, NC (US)

(73) Assignee: Renscience IP Holdings Inc., Raleigh, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/320,867

(22) Filed: Feb. 6, 2009

(65) Prior Publication Data

US 2009/0145053 A1 Jun. 11, 2009

Related U.S. Application Data

(63) Continuation of application No. 11/098,330, filed on Apr. 4, 2005, now Pat. No. 7,487,618.

(60) Provisional application No. 60/559,285, filed on Apr. 5, 2004.

(51) Int. Cl.
*E04H 9/14* (2006.01)
*E04D 3/40* (2006.01)

(52) U.S. Cl. ..... 52/84; 52/96; 52/300; 52/60

(58) Field of Classification Search ..... 52/24, 52/58, 60, 84, 94, 96, 300
See application file for complete search history.

(56) References Cited

U.S. PATENT DOCUMENTS

| | | | | |
|---|---|---|---|---|
| 397,534 | A | 12/1889 | Carroll | |
| 1,316,968 | A | 9/1919 | Neill et al. | |
| 2,021,929 | A | 11/1935 | Voigt | |
| 2,123,967 | A | 7/1938 | Richter | |
| 2,270,537 | A | 1/1942 | Ludington | |
| 2,270,538 | A | 1/1942 | Ludington | |
| 2,473,400 | A | 6/1949 | Waara | |
| 2,968,128 | A * | 1/1961 | Pelican | 52/95 |

(Continued)

FOREIGN PATENT DOCUMENTS

| | | |
|---|---|---|
| JP | 6-288050 | 10/1994 |

(Continued)

OTHER PUBLICATIONS

Overly Metal Coping, p. 4, Overly Manufacturing Company 1965. (4 pages).

(Continued)

*Primary Examiner*—Robert J Canfield
*Assistant Examiner*—Christine T Cajilig
(74) *Attorney, Agent, or Firm*—Finnegan, Henderson, Farabow, Garrett & Dunner, LLP

(57) ABSTRACT

An aerodynamic system attached to the outer side of the roof perimeter edge to mitigate wind generated vortices and uplift loads on the roof perimeter area of a building, applicable for both new constructions and retrofits of existing buildings. A roof edge guard is generally installed alongside a roof edge, and mounted onto an existing fascia or bargeboard. As an option most appropriate for new constructions, it can also be mounted directly onto a roof frame member in place of fascias or bargeboard. The configuration modifies the cross-sectional shape of otherwise abrupt roof edges that tend to generate strong vortex during high winds.

39 Claims, 4 Drawing Sheets

U.S. PATENT DOCUMENTS

| | | | |
|---|---|---|---|
| 3,012,376 | A | 12/1961 | Reddy et al. |
| 3,024,573 | A | 3/1962 | McKinley |
| 3,187,464 | A | 6/1965 | Sharp |
| 3,717,968 | A | 2/1973 | Olsen et al. |
| 3,742,668 | A | 7/1973 | Oliver |
| 4,005,557 | A | 2/1977 | Kramer et al. |
| 4,549,376 | A | 10/1985 | Hickman |
| 4,598,507 | A | 7/1986 | Hickman |
| 4,665,667 | A | 5/1987 | Taylor et al. |
| 4,672,781 | A | 6/1987 | Pichon |
| 4,780,999 | A | 11/1988 | Webb et al. |
| 4,858,406 | A | 8/1989 | Lane et al. |
| 5,016,404 | A | 5/1991 | Briggs |
| 5,031,367 | A | 7/1991 | Butzen |
| 5,189,853 | A | 3/1993 | Braine |
| 5,414,965 | A | 5/1995 | Kelley et al. |
| D361,138 | S | 8/1995 | Moore et al. |
| 5,813,179 | A | 9/1998 | Koenig, Jr. et al. |
| 5,918,423 | A | 7/1999 | Ponder |
| 6,044,601 | A | 4/2000 | Chmela et al. |
| 6,212,829 | B1 | 4/2001 | Webb |
| 6,212,836 | B1 | 4/2001 | Larson |
| 6,325,712 | B1 | 12/2001 | Lawless, III et al. |
| 6,360,504 | B1 | 3/2002 | Webb et al. |
| 6,601,348 | B2 | 8/2003 | Banks et al. |
| 6,606,828 | B1 | 8/2003 | Lin et al. |
| 6,786,018 | B2 | 9/2004 | Webb et al. |
| 2002/0083666 | A1 | 7/2002 | Webb et al. |
| 2003/0061771 | A1 | 4/2003 | Kintop |

FOREIGN PATENT DOCUMENTS

| | | |
|---|---|---|
| JP | 8-218683 | 8/1996 |
| JP | 2003-206606 | 7/2003 |

OTHER PUBLICATIONS

MM Systems Architectural Roof Edge Technologies 2001. (4 pages).

MM Systems Corp. Snap-Lok Coping Systems (Bullnose Coping), Advertising Web Page, Nov. 6, 2000, http: www.colliersf.com/mmcoping.html.

MM Systems Corp., Fascia Systems (Vari-Fascia) Advertising Web Page, Nov. 6, 2000, http: www.colliersf.com/mmfascia.

Lin et al., Supressing Extreme Suction . . . , Conf. Proc. vol. I, The 7th U.S. National Conf. on Wind Engineering, Jun. 27, 1993, p. 413-422, UCLA, Los Angeles, USA.

Surry et al., The Effect of Surroundings and Roof Corner Geometric . . . , Journal of Wind Engineering & Industrial Aerodynamics, Apr. 27, 1995, p. 115-138, vol. 58, Elsevier, Amsterdam, The Netherlands.

Metal-Era, Roof Edge Systems, Catalog No. 79709000, 1997, p. 4, p. 8 & p. 9, Metal-Era, Inc., Waukesha, WI, USA.

U.S. Appl. No. 11/236,394: Amendment, Drawings, Abstract, Claims, and Specification.

U.S. Appl. No. 11/187,100: Preliminary Amendment, Drawings, Abstract, Claims, Specification, Requirement for Restriction/Election, and Response to Election/Restriction Filed.

U.S. Appl. No. 11/286,855: Preliminary Amendment, Drawings, Abstract, Claims, Specification, Examiner's Search strategy and results, Search Information, non-final rejection, Amendment.

U.S. Appl. No. 11/286,855: Office Action dated Jul. 6, 2009 (10 pages); Response to Office Action and Amendment filed Jan. 5, 2010 (19 pages).

* cited by examiner

AERODYNAMIC ROOF EDGE GUARD

CROSS-REFERENCE TO RELATED APPLICATIONS

This application is a continuation of U.S. application Ser. No. 11/098,330, filed Apr. 4, 2005 (which matured into U.S. Pat. No. 7,487,618), which claims the benefit of U.S. Provisional Application No. 60/559,285, filed Apr. 5, 2004. The disclosure of prior U.S. application Ser. No. 11/098,330 is incorporated herein by reference.

SEQUENCE LISTING

Non-Applicable.

BACKGROUND

1. Field of Invention

This invention relates to an aerodynamic means that mitigate wind generated vortices and uplift loads on the roof perimeter area of a building, in a simple, effective, and economical way, applicable for both new constructions and retrofits of existing buildings.

2. Discussion of Prior Art

The previous and present roof construction practices normally lead to a roof perimeter configuration that tends to generate edge vortex and subjects the roof perimeter area to severe uplift and high risk of wind damage. Structural methods have been used to mitigate the risk of wind damage. For example, builders may use stronger fasteners or smaller fastener spacing for roof cover and deck in the roof edge and corner area, and use "hurricane straps" in lieu of toenails to tie down the roof framing to the wall structure. Some aerodynamic methods have been recommended, such as those disclosed in U.S. Pat. Nos. 6,601,348 of Banks et al. (2003), 4,005,557 of Kramer et al. (1977), and 5,918,423 of Ponder (1999). Banks et al. described various types of wind spoilers raised above the roof plane that function to mitigate edge vortex formation; however, the exposed structure is rather complicated, and is susceptible to wind damage itself because the raised structure subjects itself to accelerated airflow across the roof edge. Kramer et al.'s conceptions are essentially an earlier version of roof wind spoiler system that bears similar features to Banks et al. but its limited breadth impedes its effectiveness. Ponder disclosed a wind spoiler ridge cap that is specifically designed for protecting pitched gable roof ridges, while this present invention primarily deals with roof perimeter edges.

In U.S. Pat. No. 6,606,828 of this applicant et al., a series of roof edge configurations are recommended for use to mitigate vortex and high uplift in the roof perimeter areas, which are more suitable for flat and low-slope roofs that are often constructed with single ply membrane or built-up roofing. The present invention discloses roof edge configurations that are chiefly designed for deeper slope roofs that are often constructed with asphalt shingles, roof tiles and metal panels etc, and normally presented with different details at the roof perimeter.

SUMMARY OF THE INVENTION

This invention discloses an aerodynamic means that mitigate wind generated vortices and uplift loads on the roof perimeter area of a building, in a simple, effective, and economical way, applicable for both new constructions and retrofits of existing buildings. This is achieved by using a roof edge guard of an aerodynamic cross-sectional shape, attached to the outer side of the roof perimeter edge, as exemplified hereafter in the description section. The roof edge guard is generally installed alongside a roof edge, and mounted onto an existing fascia or bargeboard. As an option most appropriate for new constructions, it can also be mounted directly onto a roof frame member in place of fascias or bargeboard. The configuration modifies the cross-sectional shape of otherwise abrupt roof edges that tend to generate strong vortex during high winds. This invention is primarily applicable for gable, gambrel, mono-slope and overhung flat roof edges where there is no significant rainwater runoff. It is also applicable for roof edges where there is rainwater runoff but no draining devices such as a gutter system being installed, for example, the eaves of gable and hip roofs without gutters being attached thereon.

OBJECTS AND ADVANTAGES

Accordingly, several objects and advantages of the present invention are:

to provide roof edge configurations which reduce wind loads on the roof edge details;

to provide roof edge configurations which reduce wind loads on roofing materials, roof decks and framing in the roof perimeter areas;

to provide roof edge configurations which reduce wind uplift loads generally on a building structure that are transferred from the roof;

to provide roof edge configurations which reduce vortex scouring of roofing materials, such as asphalt shingles, roofing tiles, paver etc, and prevent them from becoming windborne missiles injuring people and damaging adjacent building envelopes during severe wind events;

to provide roof edge configurations which stabilize wind flow over the roof and minimize cyclic loads on roof components resulting from recurring winds, reducing the chances of damage due to material fatigues;

to provide roof edge configurations which prevent rainwater from being driven sideward and upward by wind turbulence and pressed through the gaps between roofing material and roof deck, and into the inner space of the roof assembly, during wind/rain events;

to provide roof edge configurations which possess the desired aerodynamic performance while maintaining an aesthetic and waterproofing functionality under both extreme and recurring weather conditions.

Further objects or advantages are to provide roof edge configurations which add an important function to a roof edge system, and which are still among the simplest, inexpensive to manufacture and convenient to install. These and still further objects and advantages will become apparent from a consideration of the ensuing description and drawings.

DESCRIPTION OF THE PREFERRED EMBODIMENTS

Figure 1A:
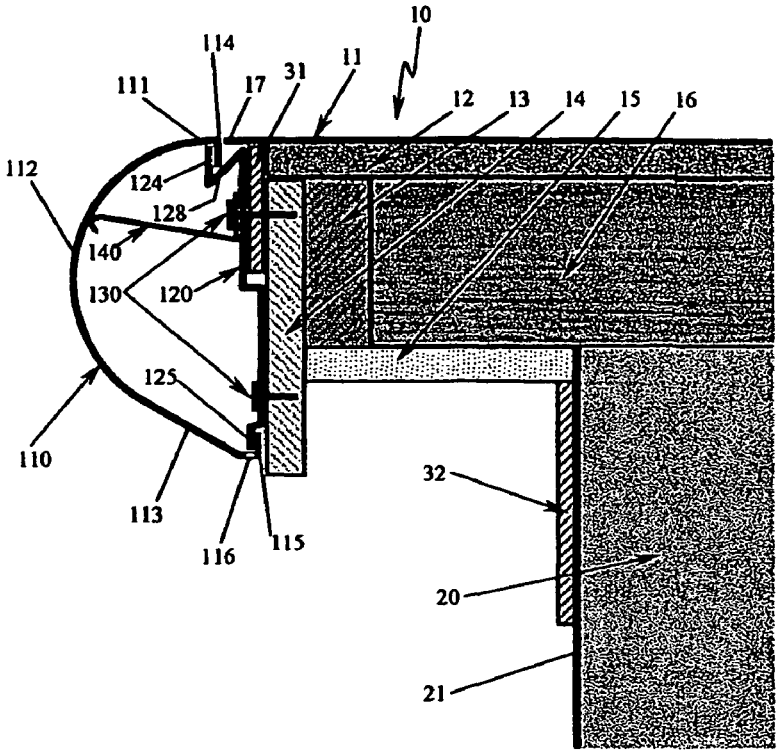
FIG. 1A schematically illustrates the cross-sectional view of one of the preferred basic configurations formed with sheet material, as being installed on an overhung gable roof edge as an example.
Figure 1B:
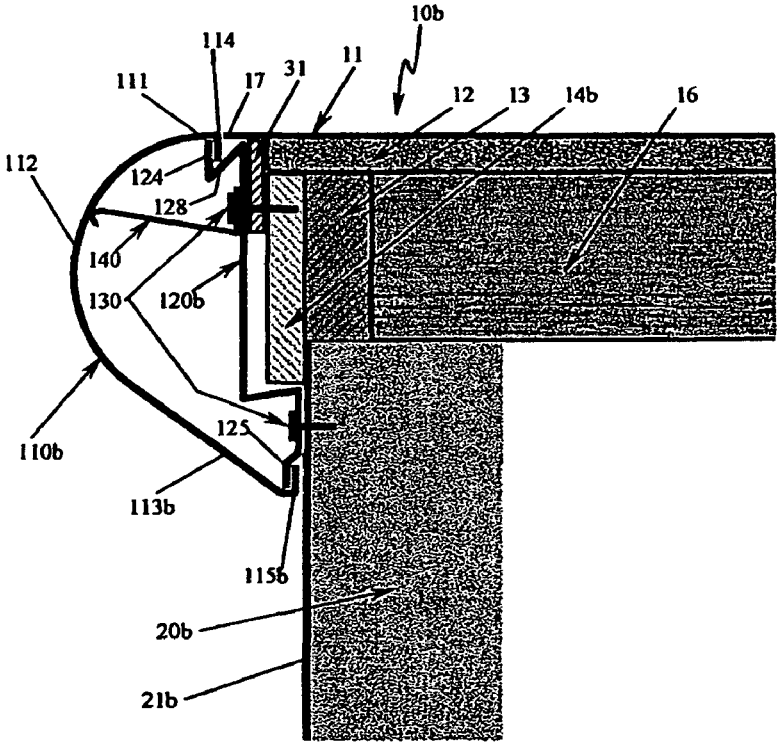
FIG. 1B shows a similar exterior configuration as being installed on a non-overhung gable roof edge as an example.

FIGS. 1A through 1C illustrate one of the preferred basic configurations of the present A roof edge guard is generally an elongated assembly and is disposed longitudinally in parallel with a roof edge. FIG. 1A shows a cross-section view for one of the preferred configurations of the present invention, a roof edge guard 110 being installed on a gable-end overhang 10 of a roof structure. A typical roof overhang is a portion of a roof structure that is supported by and hangs over a wall 20 of a building, and extends substantially outwards beyond the outer wall surface 21. The gable-end overhang 10 and associated components 11, 12, 13, 14, 15, and 16, as well as trim members 31 and 32, are not part of this invention themselves, but are included here to illustrate their relationship with the edge guard 110 that is the subject matter of this invention. Some gable roofs do not have a gable-end overhang, as exemplified in FIG. 1B, or do not have one as shown, nevertheless the spirit of the present invention holds wherever the hereindescribed aerodynamic roof edge guard may be installed properly on the gable edge of a roof. Moreover, although many of the examples in this application are illustrated for gable edges, the present invention is applicable on other types of roof edges, particularly for roof edges where there is no significant rainwater runoff. Examples of such roof edges include gable, gambrel, mono-slope (so-called lean-to), and overhung flat roof edges. For roof edges where there will be certain rainwater runoff, such as the eaves of various roof types including gable and hip roofs, this invention is also applicable if no water draining devices such as gutters are being used therein, as described later in this application.

The roof edge guard 110, exemplified here as made of sheet material, consists of an upper face portion 111, an intermediate face portion 112, and a lower face portion 113. The upper face portion 111, disposed in close proximity to the outer edge 17 of the roof covering 11 and positioned flush, or at a reasonable angle within ±55°, with the plane of the roof covering 11, facilitates a smooth wind flow across the roof edge, minimizing flow separation therein. Minor upward deviation or tolerance at installation is permissible for such roof edges where there is no significant rainwater runoff, to the extent that the upward deviation is not expected to cause debris clogging and accumulation along the roof edge. The lower face portion 113 is disposed with its edge above or in vicinity to the lower end of the bargeboard 14, or onto the wall surface below the bargeboard as shown in FIG. 1B for non-overhung roof edges, and extends generally outwardly while also upwardly in this example. The intermediate face portion 112, having one or more straight or curved segments, connects the lower and upper face portions in such a way that slope change across a junction between any adjacent two of the face portions, or of segments therein, is generally within ±55°. A gradual slope change minimizes the chances of wind flow separation and vortex formation. Notwithstanding with this general or global slope change limit, corrugated segment or segments, or small step or steps on the outer face of a roof edge guard, can be used within, or in lieu of, the face portions without compromising its functionality. Local slope change exceeding ±55° within the segment of corrugation or steps is permissible as long as the depth of the corrugation or the riser size of the step is sufficiently small and does not increase the chances of major flow separation.

The roof edge guard 110 may be mounted on to the roof edge with any appropriate means that can ensure the configurations of the outer face of the roof edge guard as described in detail herein and defined by the accompanied claims. An exemplary mounting method is described here merely to showcase a relatively simple method that uses anchor bars 120 and fasteners 130, for an aerodynamic roof edge guard 110 made from resilient sheet material. In FIG. 1A, and similarly in FIG. 1B, an anchor bar 120 is secured to the bargeboard 14 with a plurality of fasteners. The roof edge guard 110 is then snapped on to the anchor bar 120. This is done by hooking the edge guard's top bend 114 on the anchor bar's top bend 124 and pressing the edge guard downwards and inwards until the edge guard's bottom bend 115 clicked into the anchor bar's bottom bend 125. A spring clip 140 provides additional support for the edge guard 110. Small amount of rainwater may slip through the gap between the top bend 114 of the edge guard and the protruding portion 17 of the roof covering. A V-shape 128 on the upper part of the anchor bar forms a channel to catch and guide this small amount of water down the slope along the gable edge, prevent it from wetting the normally wooden components 31 and 14, and drain it off where the anchor bar terminates. Along the length of the gable edge, either multiple discrete anchor bars 120, or continuous cleats of such similar cross-sectional shapes, can be used for sloped roof edges.

In fact, any other suitable mechanisms of similar functions may be used for mounting the roof edge guard 110 onto a roof edge.

Very limited amount of rainwater or moisture may also slip into the inside chamber of the edge guard 110. Practically, since a roof edge guard mounted on a gable edge is sloped down along the gable edge, water inside the edge guard 110 can drain out through its lower end. For roof edges that are horizontal or with a low slope, a plurality of drain holes 116 can be drilled along the bottom edge of the edge guard 110 providing a means for draining and venting of condensation water or residual rainwater inside the edge guard's chamber. Similar optional drain holes (not shown) can also be used on the lower edge of the channel 128 for a continuous mounting cleat.

The aerodynamic roof edge guard 110 has at least three functions. The first is to minimize the extent of flow separation and the strength of associated vortices over a roof edge, or to completely eliminate them for some approach wind directions. These effects tend to be more pronounced for higher wind speeds as desired. High uplifts and strong scouring that result from wind-induced edge vortices above the roof, are prime causes for wind damage to roof components. Secondly, it shields the underside of the protruding portion 17 of the roof covering 11, such as an array of shingles, shakes, or metal panels, from upward flow and pressure that tend to peel the roof covering 11 upwards and away from other parts of the roof edge assembly 10. The third function is to prevent upward flow-driven rain from being pressured to infiltrate into the roof structure through the unsealed gaps between the roof covering 11 and the trim member 31.

For roof edges without overhang, as illustrated in FIG. 1B, a roof edge guard 110*b* can be mounted with the bottom bend 115*b* attached directly to the wall surface 21*b* or any vertical or nearly vertical surface therein. For applications on existing buildings, this optional method can be used only if the wall siding or surface material thereof is suitable for mounting; otherwise, mounting the edge guard 110*b* onto a fascia or bargeboard 14*b*, similar to the method illustrated in FIG. 1A, is recommended.

Figure 2:
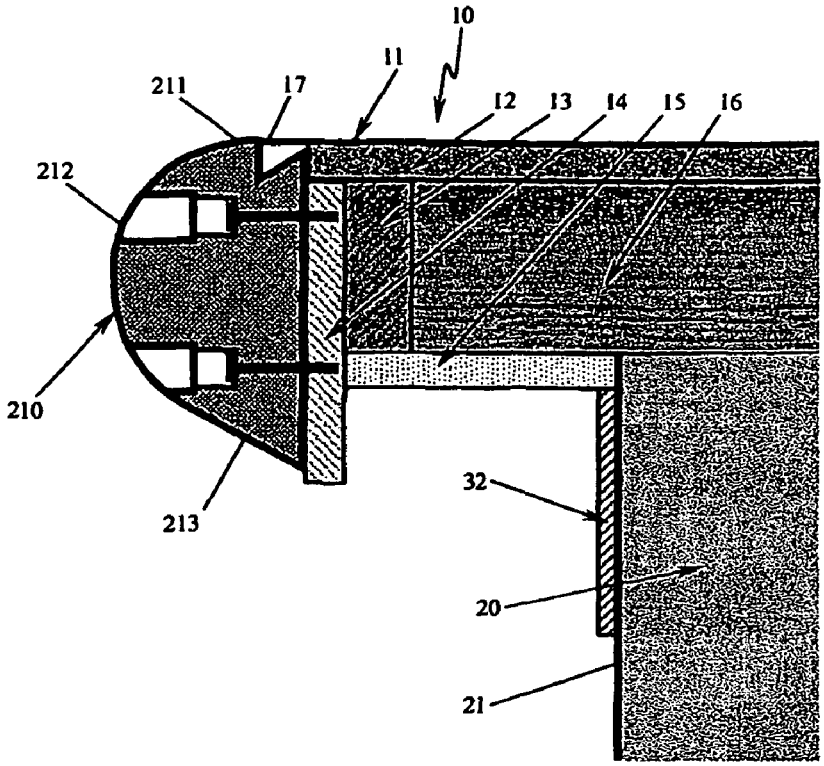
FIG. 2 illustrates a similar exterior configuration formed with solid material as an option.

An aerodynamic roof edge guard can also be made from solid materials, such as solid wood, or any other suitable materials, and be mounted on a roof edge with any applicable means, so long as the aerodynamic shapes of the outer face portions are maintained. FIG. 2 exemplifies an aerodynamic roof edge guard 210 made from solid wood material as being mounted on a gable-end overhang 10, where the outer face portions 211, 212 and 213 are equivalent to the face portions 111, 112 and 113 in FIG. 1A.

Figure 3:
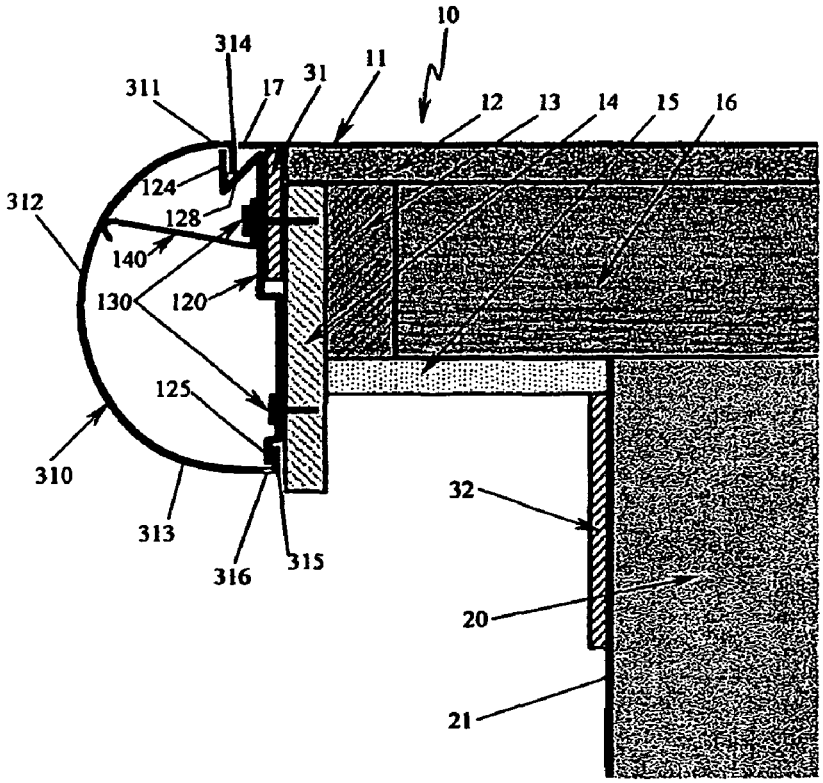
FIGS. 3, 4 and 5 exemplify exterior shapes that have little compromises in functionality while providing alternative appearances for aesthetic purposes.

Some other embodiments of this invention are illustrated in FIGS. 3 through 7. FIG. 3 shows an edge guard 310 shaped primarily with a semi-circle or semi-ellipse, where the outer face portions 311, 312 and 313 are equivalent to the face portions 111, 112 and 113 in FIG. 1A. It should be noted that this configuration is not a preferred one for roof edges with no overhang since strong upward flow along the wall surface would exert significant pressure on the underside of the lower face portion 313 given its nearly horizontal layout. Such high pressure would have several undesired effects. The first is to increase the upward load on the edge guard 310. Secondly, this high pressure would transmit into the inside chamber of the edge guard 310 through the unsealed gap between the edge guard bottom bend 315 and the wall surface, and thus increase the outward load on the edge guard. If discrete anchor bars are used along the roof edge for mounting, the residual of this high pressure could also reach and exert on the underside of the protruding portion 17 of roof covering 11. The third undesired effect would be the potential pressure-driven infiltration of residual rainwater or moisture from the pressurized inside chamber of the edge guard 310 into the roof edge assembly, to which the edge guard 310 would have been attached. In addition, this configuration will conceivably yield higher outward negative pressures on the outer face of the edge guard 310 for such a direct wall contact application. Hence, for roof edges without overhang, configurations such as one depicted in FIG. 1B are recommended.

Figure 4:
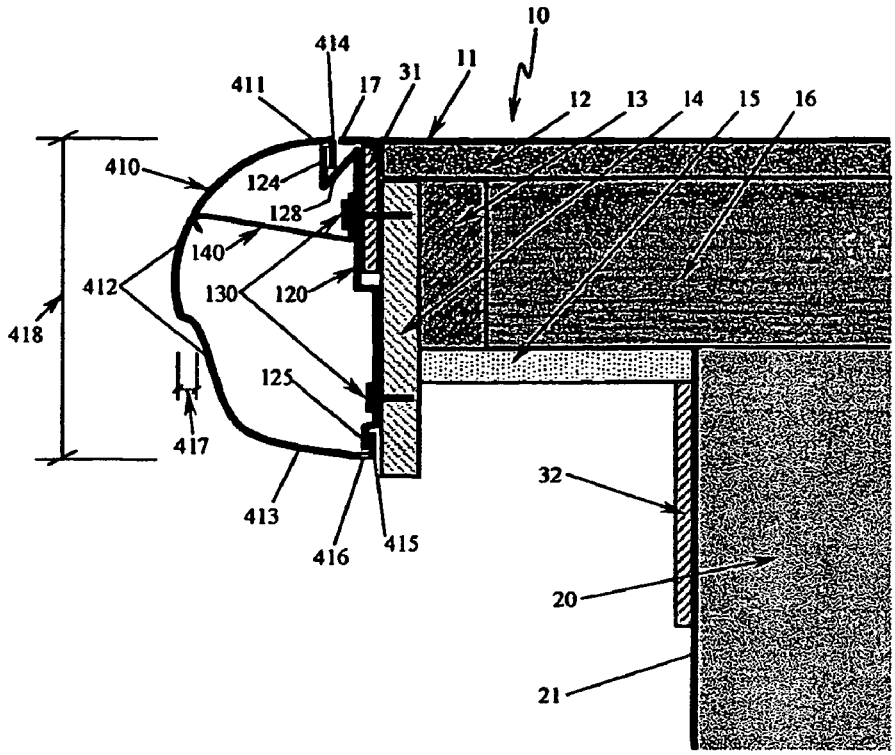

For aesthetic considerations, certain modifications to the profile shape of the outer face of a roof edge guard are allowable. For example, the lower face portion of a roof edge guard can be shaped to match or to approximate the shape of some of the roof edge gutters that may be common in a geographic region or prevailing for a specific roof edge system maker. FIG. 4 shows an example of such modifications, where the outer face portions 411, 412 and 413 are equivalent to the face portions 111, 112 and 113 in FIG. 1A. Other modified profiles are also possible; however, such modified profiles should only contain steps, if any, that have a riser size 417 less than 25% of the total height 418 of the edge guard. Again, for roof edges without overhang or other direct wall contact applications, the slope of the lower face portion 413 should be steeper where it contacts or approaches the wall surface 21.

Figure 5:
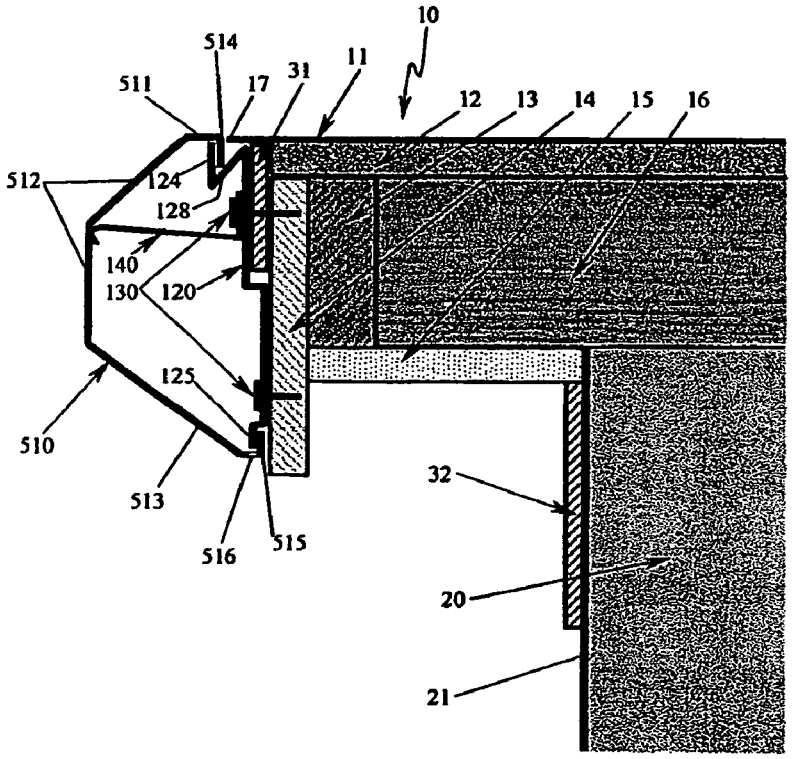

Configurations primarily comprising of plane surfaces can also be utilized. FIG. 5 shows an example of such alternative configurations, where the outer face portions 511, 512 and 513 are equivalent to the face portions 111, 112 and 113 in FIG. 1A.

Figure 6:
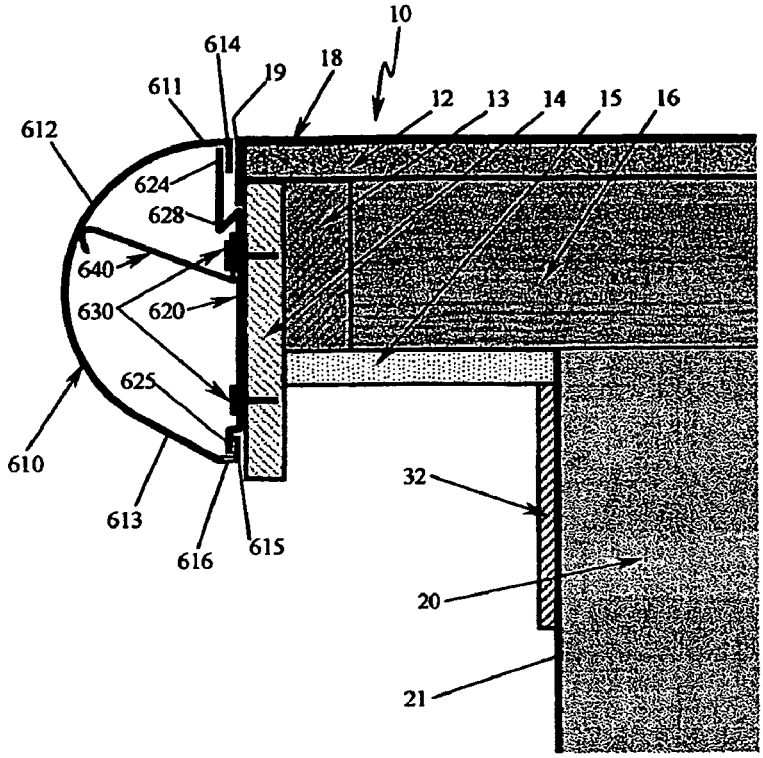
FIG. 6 illustrates an example to showcase the recommended installation option for situations where roof covering is wrapped downward around the roof deck edge, as often seen for metal roofing.

FIG. 6 provides an example for an edge guard 610 being installed on a roof edge that has the roof covering 18 wrapped downwards, most often seen with metal roof coverings, such as metal tiles, metal shakes and metal panels, as well as clay tiles in some instances.

Figure 7:
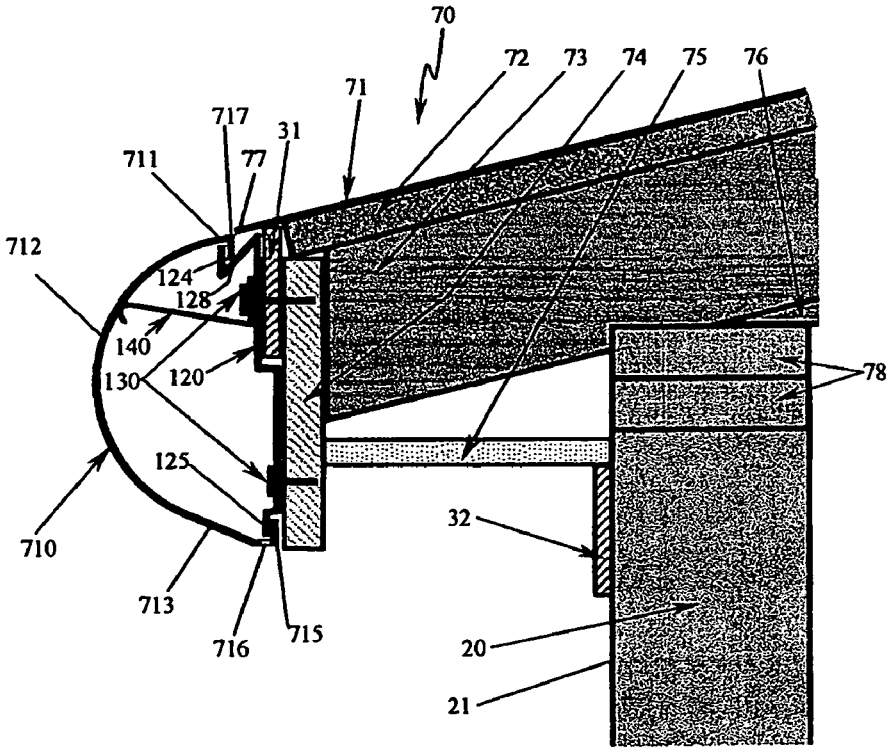
FIG. 7 demonstrates the usage of an example roof edge guard according to this invention for eave edges where no gutter system is used.

FIG. 7 illustrates a roof edge guard 710 being used on an eave edge of a sloped roof where a draining device such as a gutter system is not being used. For this application, the upper arris 717 of the roof edge guard cover 710 is also disposed in close proximity to, but slightly lower than, the protruding edge 77 of the roof covering 71. An outwardly and downwardly extending upper face portion 711 is also preferred to allow rainwater shed off from the roof to continue run over, and eventually be shed off from, the roof edge guard 710. Discrete anchor bars 120, instead of continuous cleat, mounted along the eave edge, are preferred for this application. This is to prevent runoff rainwater, of which a limited amount can slip through the gap between the edge guard upper arris 717 and the roof covering outer edge 77, from being built up in the V-shaped channel 128.

Installation and Operation

An embodiment of this invention is a passive flow control device or design for building roof edges. Once installed properly, it stays functioning in such a way that it mitigates vortex formation at a roof edge and reduces uplifts and roof vortex scouring, whenever the wind blows towards a building bearing atop such roof edge devices or designs, and requires no active operational intervention.

Conclusion, Ramifications, and Scope

It is apparent that roof edge guards of this invention provide aerodynamically advantageous devices or designs for mitigating roof edge vortex and roof uplift, and are still among the simplest, most inexpensive to manufacture and convenient to install.

Although the description above contains many specifications, these should not be construed as limiting the scope of the invention but as merely providing illustrations of some of the presently preferred embodiments of this invention. Various changes, modifications, variations can be made therein without departing from the spirit of the invention. Roof edge guards can be made of any reasonably durable material with any appropriate means of fabrication as long as a configuration according to the spirit of this invention is accomplished to support the described working mechanism and to provide the associated functionality. Various surface portions of a roof edge guard may also bear such surface details as corrugation or steps of adequate sizes, as opposed to perfectly smooth surfaces. Any appropriate conventional or new mounting method can be used to secure a roof edge guard to a roof perimeter without departing from the spirit of this invention. Thus the scope of the invention should be determined by the appended claims and their legal equivalents, rather than by the examples given.

What I claim as my invention is:

1. An assembly attached to an outer surface of at least part of a perimeter overhang of a roof on a walled structure, the assembly comprising:

an elongated fascia member having an outer face including at least a lower face portion, an intermediate face portion, and an upper face portion consecutively adjoining to form a generally arch-like cross-sectional shape for the outer face of the fascia member, wherein at least a segment of the upper face portion is generally disposed with an end thereof being in close proximity to an upper part of the outer surface of the perimeter overhang, wherein the upper face portion extends generally laterally and generally outwardly away from the perimeter overhang and forms an angle within 55° of a roof plane where the upper face portion approaches the perimeter overhang, wherein the fascia member does not extend substantially above the perimeter overhang, wherein the fascia member does not extend above the roof inwardly of the outermost part of the roof, wherein at least a segment of the lower face portion is generally disposed with an end thereof being in proximity to a lower part of the perimeter overhang, wherein the intermediate face portion connects the lower face portion and the upper face portion, wherein slope change across respective junctions between all adjacent face portions, and between all adjacent segments therein, is generally within 55°, wherein a laterally outermost point on the generally arch-like outer face of the fascia member is not located closer to said end of the lower face portion than to said end of the upper face portion, and wherein the fascia member reduces aerodynamic forces on the roof.

2. The assembly of claim 1, wherein the lower face portion extends generally laterally and generally outwardly away from the perimeter overhang.

3. The assembly of claim 1, wherein the fascia member includes drain holes provided in a bottom of the fascia member.

4. The assembly of claim 1, wherein a laterally outermost point on the generally arch-like outer face of the fascia member is located closer to said end of the upper face portion than to said end of the lower face portion.

5. An assembly attached to an outer surface of at least part of a perimeter overhang of a roof on a walled structure, the assembly comprising:

an elongated fascia member having an outer face including at least a lower face portion, an intermediate face portion, and an upper face portion consecutively adjoining to form a generally arch-like cross-sectional shape for the outer face of the fascia member wherein at least a segment of the upper face portion is generally disposed with an end thereof being in close proximity to an upper part of the outer surface of the perimeter overhang, wherein the upper face portion extends generally laterally and generally outwardly away from the perimeter overhang and forms an angle within 55° of a roof plane where the upper face portion approaches the perimeter overhang, wherein the fascia member does not extend substantially above the perimeter overhang, wherein the fascia member does not extend laterally inward of a vertical plane defined by the outer surface of the perimeter overhang, wherein at least a segment of the lower face portion is generally disposed with an end thereof being in proximity to a lower part of the perimeter overhang, wherein the intermediate face portion connects the lower face portion and the upper face portion, wherein slope change across respective junctions between all adjacent face portions, and between all adjacent segments therein, is generally within 55°, and wherein the fascia member reduces aerodynamic forces on the roof.

6. The assembly of claim 1, further comprising a mounting device to secure the fascia member to the perimeter overhang.

7. The assembly of claim 6, wherein the mounting devices comprises an anchor bar and a fastener.

8. The assembly of claim 7, wherein the anchor bar defines a channel configured to facilitate drainage.

9. The assembly of claim 1, further comprising a spring clip extending between an inner surface of the fascia member and the outer surface of the perimeter overhang.

10. An assembly attached to an outer surface of at least part of a perimeter of a roof on a walled structure, the assembly comprising:

an elongated fascia member having an outer face including at least a lower face portion, an intermediate face portion, and an upper face portion consecutively adjoining to form a generally arch-like cross-sectional shape for the outer face of the fascia member, wherein at least a segment of the upper face portion is generally disposed with an end thereof being in close proximity to an upper part of the outer surface of the roof perimeter, wherein the upper face portion extends generally laterally and generally outwardly away from the roof perimeter and forms an angle within 55° of a roof plane where the upper face portion approaches the roof perimeter, wherein the fascia member does not extend substantially above the roof, wherein the fascia member does not extend above the roof inwardly of the outermost part of the roof, wherein at least a segment of the lower face portion is generally disposed with an end thereof being in proximity to a surface portion below the upper part of the outer surface of the roof perimeter, wherein the intermediate face portion connects the lower face portion and the upper face portion, wherein slope change across respective junctions between all adjacent face portions, and between all adjacent segments therein, is generally within 55°, wherein a laterally outermost point on the generally arch-like outer face of the fascia member is not located closer to said end of the lower face portion than to said end of the upper face portion, and wherein the fascia member reduces aerodynamic forces on the roof.

11. The assembly of claim 10, wherein the lower face portion extends generally laterally and generally outwardly away from a surface of a wall beneath the roof.

12. The assembly of claim 10, wherein the fascia member includes drain holes provided in a bottom of the fascia member.

13. The assembly of claim 10, wherein a portion of the lower face portion is substantially planar and forms an obtuse exterior angle with the surface portion.

14. The assembly of claim 10, wherein a laterally outermost point on the generally arch-like outer face of the fascia member is located closer to said end of the upper face portion than to said end of the lower face portion.

15. An assembly attached to an outer surface of at least part of a perimeter of a roof on a walled structure, the assembly comprising:

an elongated fascia member having an outer face including at least a lower face portion, an intermediate face portion, and an upper face portion consecutively adjoining to form a generally arch-like cross-sectional shape for the outer face of the fascia member, wherein at least a segment of the upper face portion is generally disposed with an end thereof being in close proximity to an upper part of the outer surface of the roof perimeter, wherein the upper face portion extends generally laterally and generally outwardly away from the roof perimeter and forms an angle within 55° of a roof plane where the upper face portion approaches the roof perimeter, wherein the fascia member does not extend substantially above the roof, wherein at least a segment of the lower face portion is generally disposed with an end thereof being in proximity to a surface portion below the upper part of the outer surface of the roof perimeter, wherein the lower face portion extends generally laterally and generally outwardly away from a surface of a wall beneath the roof, wherein the fascia member does not extend laterally inward of a vertical plane defined by the surface of the wall beneath the roof, wherein the intermediate face portion connects the lower face portion and the upper face portion, wherein slope change across respective junctions between all adjacent face portions, and between all adjacent segments therein, is generally within 55°, and wherein the fascia member reduces aerodynamic forces on the roof.

16. The assembly of claim 10, further comprising a mounting device to secure the fascia member to the roof perimeter.

17. The assembly of claim 16, wherein the mounting devices comprises an anchor bar and a fastener.

18. The assembly of claim 17, wherein the anchor bar defines a channel configured to facilitate drainage.

19. The assembly of claim 10, further comprising a spring clip extending between an inner surface of the fascia member and the outer surface of the roof perimeter.

20. An assembly for attachment to an outer surface of at least part of a roof on a walled structure, the assembly comprising:

an elongated fascia member having an outer face including at least a lower face portion, an intermediate face portion, and an upper face portion consecutively adjoining to form a generally arch-like cross-sectional shape for the outer face of the fascia member, wherein at least a segment of the upper face portion is configured to be generally disposed with an end thereof being in close proximity to an upper part of the outer surface of the roof, wherein the upper face portion is configured to extend generally laterally and generally outwardly away from the roof and form an angle within 55° of a roof plane where the upper face portion approaches the roof, wherein the fascia member is configured such that the fascia member does not extend substantially above the roof, wherein the fascia member is configured such that the fascia member does not extend above the roof inwardly of the outermost part of the roof, wherein at least a segment of the lower face portion is configured to be generally disposed with an end thereof being in proximity to a surface portion below the upper part of the outer surface of the roof, wherein the intermediate face portion connects the lower face portion and the upper face portion, wherein slope change across respective junctions between all adjacent face portions, and between all adjacent segments therein, is generally within 55°, wherein a laterally outermost point on the generally arch-like outer face of the fascia member is not located closer to said end of the lower face portion than to said end of the upper face portion, and wherein the fascia member reduces aerodynamic forces on the roof.

21. The assembly of claim 20, wherein a portion of the lower face portion is substantially planar and is configured to form an obtuse exterior angle with the surface portion.

22. The assembly of claim 20, further comprising a mounting device to secure the fascia member to the roof.

23. The assembly of claim 22, wherein the mounting devices comprises an anchor bar and a fastener.

24. The assembly of claim 23, wherein the anchor bar defines a channel configured to facilitate drainage.

25. An assembly for attachment to an outer surface of at least part of a roof on a walled structure, the assembly comprising:

an elongated fascia member having an outer face including at least a lower face portion, an intermediate face portion, and an upper face portion consecutively adjoining to form a generally arch-like cross-sectional shape for the outer face of the fascia member; and a mounting device to secure the fascia member to the roof, wherein at least a segment of the upper face portion is configured to be generally disposed with an end thereof being in close proximity to an upper part of the outer surface of the roof, wherein the upper face portion is configured to extend generally laterally and generally outwardly away from the roof and form an angle within 55° of a roof plane where the upper face portion approaches the roof, wherein the fascia member is configured such that the fascia member does not extend substantially above the roof, wherein at least a segment of the lower face portion is configured to be generally disposed with an end thereof being in proximity to a surface portion below the upper part of the outer surface of the roof, wherein the intermediate face portion connects the lower face portion and the upper face portion, wherein slope change across respective junctions between all adjacent face portions, and between all adjacent segments therein, is generally within 55°, wherein a laterally outermost point on the generally arch-like outer face of the fascia member is located closer to said end of the upper face portion than to said end of the lower face portion, wherein the fascia member reduces aerodynamic forces on the roof, wherein the mounting devices comprises an anchor bar and a fastener, wherein the anchor bar defines a channel configured to facilitate drainage, and wherein the fascia member contacts a portion of the anchor bar defining the channel.

26. The assembly of claim 20, further comprising a spring clip configured to extend between an inner surface of the fascia member and the outer surface of the roof.

27. The assembly of claim 20, wherein the assembly is configured to be attached to a perimeter overhang of the roof.

28. A method of reducing wind damage to components of a roof, comprising:

at least partially minimizing, via the assembly of claim 20 attached to an outer surface of at least part of the roof, flow separation and strength of vortices of wind coming in contact with the assembly.

29. The method of claim 28, further comprising mitigating, via the assembly, wind-generated vortices and uplift loads on the components of the roof.

30. The method of claim 28, shielding from upward wind flow, via the assembly, an underside of a protruding portion of a covering on the roof.

31. The method of claim 28, limiting, via the assembly, infiltration of upward-flow-driven rain into components of the roof.

32. The method of claim 28, further comprising attaching the assembly to the outer surface of at least a portion of the roof.

33. The assembly of claim 1, wherein said end of the upper face portion of the fascia is spaced outwardly from the outermost part of the roof such that a gap is defined therebetween.

34. The assembly of claim 33, wherein the outermost part of the roof is an outer edge of a roof covering.

35. The assembly of claim 5, wherein a laterally outermost point on the generally arch-like outer face of the fascia member is located closer to said end of the upper face portion than to said end of the lower face portion.

36. The assembly of claim 10, wherein said end of the upper face portion of the fascia is spaced outwardly from the outermost part of the roof such that a gap is defined therebetween.

37. The assembly of claim 36, wherein the outermost part of the roof is an outer edge of a roof covering.

38. The assembly of claim 15, wherein a laterally outermost point on the generally arch-like outer face of the fascia member is located closer to said end of the upper face portion than to said end of the lower face portion.

39. The assembly of claim 20, wherein the fascia is configured such that the said end of the upper face portion of the fascia is spaced outwardly from the outermost part of the roof such that a gap is defined therebetween.

* * * * *

UNITED STATES PATENT AND TRADEMARK OFFICE

CERTIFICATE OF CORRECTION

PATENT NO. : 7,827,740 B2
APPLICATION NO. : 12/320867
DATED : November 9, 2010
INVENTOR(S) : Jason JianXiong Lin It is certified that error appears in the above-identified patent and that said Letters Patent is hereby corrected as shown below:

In Column 7, line 36, please change “member” to --member,--.

Signed and Sealed this
Twenty-second Day of February, 2011

David J. Kappos

David J. Kappos
*Director of the United States Patent and Trademark Office*